US009585527B2

(12) United States Patent
Mizushima et al.

(10) Patent No.: US 9,585,527 B2
(45) Date of Patent: Mar. 7, 2017

(54) FOAMER DISPENSER

(71) Applicants: Hiroshi Mizushima, Tokyo (JP); Tsuyoshi Sasaki, Tokyo (JP)

(72) Inventors: Hiroshi Mizushima, Tokyo (JP); Tsuyoshi Sasaki, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/901,798

(22) PCT Filed: May 16, 2014

(86) PCT No.: PCT/JP2014/002575

§ 371 (c)(1),
(2) Date: Dec. 29, 2015

(87) PCT Pub. No.: WO2015/008414

PCT Pub. Date: Jan. 22, 2015

(65) Prior Publication Data

US 2016/0367084 A1 Dec. 22, 2016

(30) Foreign Application Priority Data

Jul. 17, 2013 (JP) ..... 2013-148884
Jul. 17, 2013 (JP) ..... 2013-148885

(51) Int. Cl.
*B05B 11/00* (2006.01)
*A47K 5/14* (2006.01)
(Continued)

(52) U.S. Cl.
CPC ..... *A47K 5/14* (2013.01); *A47K 5/1211* (2013.01); *B05B 7/005* (2013.01); *B05B 11/3001* (2013.01); *B05B 11/3087* (2013.01)

(58) Field of Classification Search
CPC .... A47K 5/1211; A47K 5/14; B05B 11/3001; B05B 11/3087; B05B 7/005
See application file for complete search history.

(56) References Cited

U.S. PATENT DOCUMENTS 6,053,364 A * 4/2000 van der Heijden . B05B 11/3087 222/145.6
6,536,629 B2 * 3/2003 van der Heijden . B05B 11/0005 222/190
(Continued)

FOREIGN PATENT DOCUMENTS

JP H08-230961 A 9/1996
JP 2004-121889 A 4/2004
(Continued)

OTHER PUBLICATIONS

Aug. 12, 2014 International Search Report issued in International Patent Application No. PCT/JP2014/002575.

*Primary Examiner* — Frederick C Nicolas
*Assistant Examiner* — Bob Zadeh
(74) *Attorney, Agent, or Firm* — Oliff PLC

(57) ABSTRACT

A foamer dispenser includes a hollow stem, an air piston configured to pressurize and pump air, and a tubular guide that is coupled integrally to the air piston, that defines an airway for air supply between the hollow stem and the tubular guide, that holds the hollow stem slidably, and that is configured to come out of abutment with the flange in response to sliding of the hollow stem, thereby opening the airway is provided. The flange is provided with: an outer annular wall protruding upward from an outer edge of the flange; and a guide rib located on an outer side of the tubular guide in the radial direction and configured to be guided by the tubular guide during sliding of the hollow stem.

6 Claims, 3 Drawing Sheets

(51) Int. Cl.
*A47K 5/12* (2006.01)
*B05B 7/00* (2006.01)

(56) References Cited

U.S. PATENT DOCUMENTS

| | | | | |
|---|---|---|---|---|
| 6,840,408 | B1 * | 1/2005 | Foster | B05B 11/3074 222/190 |
| 7,757,899 | B2 * | 7/2010 | van der Heijden | B05B 7/0037 222/1 |
| 8,079,497 | B2 * | 12/2011 | Brouwer | B05B 7/0037 222/135 |
| 8,496,142 | B2 * | 7/2013 | Uehira | B05B 11/0064 222/190 |
| 2006/0219738 | A1 * | 10/2006 | IIzuka | A45D 34/04 222/190 |
| 2013/0313285 | A1 * | 11/2013 | Iizuka | A47K 5/14 222/190 |
| 2016/0167075 | A1 * | 6/2016 | Mizushima | B05B 11/0016 222/189.11 |

FOREIGN PATENT DOCUMENTS

| | | | |
|---|---|---|---|
| JP | 2009-202097 | A | 9/2009 |
| JP | 2011-156445 | A | 8/2011 |

* cited by examiner

FOAMER DISPENSER

TECHNICAL FIELD

The present disclosure relates to a foamer dispenser that dispenses a mixture of a content medium and air in the form of foam.

BACKGROUND

To omit the need for the action of foaming a content medium to improve usability, containers filled with shampoo, body soap, hand soap, face cleanser, and so forth are often used with a dispenser that allows the content medium contained in the container to be directly dispensed in the form of foam.

Such a dispenser includes a base cap, which is held by a mouth of the container, and a single cylinder fitted to the base cap. The single cylinder includes coaxially and serially arranged two pistons, i.e., one piston that sucks, pressurizes, and pumps the content medium, and the other piston that sucks, pressurizes, and pumps air. By actuating these pump pistons synchronously by depressing a nozzle head, the content medium and air are sucked, pressurized, and pumped into the corresponding cylinder portions. The content medium and air are mixed together in confluence space located on outlet sides of the pumps and passed through a foaming member such as a mesh. Thus, the content medium is dispensed in the form of foam. (Refer to Patent Literature 1, for example.)

The foaming member is generally assembled to a jet ring (which is called "the foaming member fitting tube" in Patent Literature 1) in advance to facilitate assembly to, for example, a dispenser. The jet ring includes, in a lower part thereof, a small-diameter tubular portion that is suited for being inserted into an upper end portion of a stem.

CITATION LIST

Patent Literature

PTL1: JPH08230961A

SUMMARY

Technical Problem

A foamer dispenser structured as above may face the problem, upon repeated dispensing of the content medium, that the content medium in the confluence space possibly flows backward to an airway communicating with the cylinder. When the backflow of the content medium accumulates in the air cylinder portion, a supply of air is decreased, resulting in a change in mixture ratio of the content medium and air which may cause deterioration in quality of the foam (e.g., coarsening of foam texture).

The present disclosure is to solve the above problem, and the present disclosure is to provide a novel foamer dispenser that is capable of preventing backflow of the content medium into the air cylinder to maintain a satisfactory quality of the foam.

Solution to Problem

One of aspects of the present disclosure resides in a foamer dispenser, including: a base cap held by a mouth of a container; two pumps suspended from and held to the mouth of the container by the base cap, the two pumps being one pump configured to suck, pressurize, and pump a content medium and the other pump configured to suck, pressurize, and pump air; and a nozzle head configured to mix the content medium and the air pumped from the corresponding pumps and to foam the mixture of the content medium and the air by a foaming member disposed inside the nozzle head to be dispensed to outside through an internal passage. The pump configured to suck, pressurize, and pump the content medium includes: a small-diameter tubular body provided in a bottom portion thereof with a suction port for inflow of the content medium; a hollow piston disposed in abutment with an inner circumferential surface of the small-diameter tubular body and configured to slide toward the bottom portion of the small-diameter tubular body to pressurize and pump the content medium that is present in the small-diameter tubular body; and a hollow stem including an inner passage through which the content medium pumped from the hollow piston is supplied to the nozzle head and also including a flange protruding from an outer circumferential surface of the hollow stem outward in a radial direction. The pump configured to suck, pressurize, and pump the air includes: a large-diameter tubular body including a bottom portion coupled integrally to the small-diameter tubular body; an air piston disposed in abutment with an inner circumferential surface of the large-diameter tubular body and configured to slide toward the bottom portion of the large-diameter tubular body to pressurize and pump the air that is present in the large-diameter tubular body; and a tubular guide that is coupled integrally to the air piston, that surrounds the hollow stem to define a first airway between the hollow stem and the tubular guide, that holds the hollow stem in a manner such that the hollow stem is slidable, and that is configured to come out of abutment with the flange in response to downward sliding of the hollow stem, thereby opening the first airway to supply the air pumped by the air piston to the nozzle head through the first airway. The flange is provided with: an outer annular wall protruding upward from an outer edge of the flange; and a guide rib located on an outer side of the tubular guide in the radial direction and configured to be guided by the tubular guide during sliding of the hollow stem.

In a preferred embodiment, the outer annular wall and the flange are coupled integrally via the guide rib.

In another preferred embodiment, the nozzle head includes a jet ring that holds the foaming member, and the jet ring includes: an upper tubular portion surrounding and holding the foaming member; a middle tubular portion coupled integrally to the upper tubular portion and having an outer circumferential wall that is dented inward in the radial direction to support the foaming member from below; and a lower tubular portion that is coupled integrally to the middle tubular portion, that has an inner circumferential surface provided with a plurality of vertical ribs abutting against the outer circumferential surface of the hollow stem to be fitted and held to the hollow stem, and that defines a second airway communicating with the first airway between any two adjacent vertical ribs.

In yet another preferred embodiment, the jet ring further includes at least one rib that is provided on the outer circumferential wall dented inward in the radial direction and that extends vertically.

Advantageous Effects

The foamer dispenser of the present disclosure includes a tubular guide that defines the first airway between the hollow stem and the tubular guide, that holds the hollow stem in a manner such that the hollow stem is slidable, and that is configured to come out of abutment with the flange of the hollow stem in response to downward sliding of the hollow stem, thereby opening the first airway to supply the air pumped by the air piston to the nozzle head through the first airway. Furthermore, the flange is provided in the outer edge thereof with the outer annular wall protruding upward. Accordingly, even when the content medium that is present in the nozzle head flows backward to the airway, the outer annular wall effectively prevents the problem of the content medium flowing into the large-diameter tubular body, i.e., the air cylinder portion. Thus, a satisfactory quality of the foam of the content medium is maintained even after repeated use. The flange is provided with the guide rib located on the outer side of the tubular guide in the radial direction, and the guide rib serves to guide the hollow stem while the hollow stem slides relative to the tubular guide. Accordingly, smooth sliding of the hollow stem relative to the tubular guide is achieved.

When the outer annular wall and the flange are coupled integrally via the guide rib, the outer annular wall and the flange are reinforced by the guide rib.

Meanwhile, in recent years, there is a demand for such a foamer dispenser to dispense a significantly larger dose of the content medium per actuation than before (e.g., from twice to five times more than before). However, in this situation, a greater pressure is applied to the foaming member with a conventional dimension due to the larger amount of the content medium, and a greater force is required to depress the nozzle head, resulting in the problem of deteriorated operability. Accordingly, efforts are being made to reduce force required to depress the nozzle head by increasing the dimension (diameter) of the foaming member than before.

Under the above background, molding the jet ring inevitably requires a significantly larger amount of resin. Furthermore, an excessive difference in dimension between the small-diameter tubular portion, provided in the lower portion of the jet ring, to be inserted into the upper end portion of the stem, and a portion of the jet ring that is to be mounted with the foaming member is considered to adversely affect stability (e.g., shakiness) and moldability when the jet ring is fitted to the stem. In view of the above, minimization of the amount of resin used in the jet ring and simplification of the shape of the jet ring are also required in the efforts of achieving a larger dose of the content medium per actuation than before.

Since the jet ring of the present disclosure includes the middle tubular portion having the outer circumferential wall that is dented inward in the radial direction, the amount of resin is reduced by the reduced dimension. Furthermore, the middle tubular portion of the jet ring holds, from below, the foaming member held in the upper tubular portion and thus, the foaming member is held in a predetermined position. Moreover, the jet ring is configured to be fitted and held to the hollow piston by the plurality of vertical ribs provided on inner circumferential surface of the lower tubular portion, and this structure omits the need for the jet ring to have a small-diameter tubular portion in the upper part as is required in a conventional jet ring. Accordingly, the shape of the jet ring is simplified. Moreover, a gap between any two adjacent vertical ribs may serve as the airway for the air pumped by the air piston.

When the jet ring further includes at least one rib that is provided on the outer circumferential wall dented inward in the radial direction of the jet ring and that extends vertically, the jet ring is reinforced without the need for increasing the amount of resin significantly.

DETAILED DESCRIPTION

Figure 1:
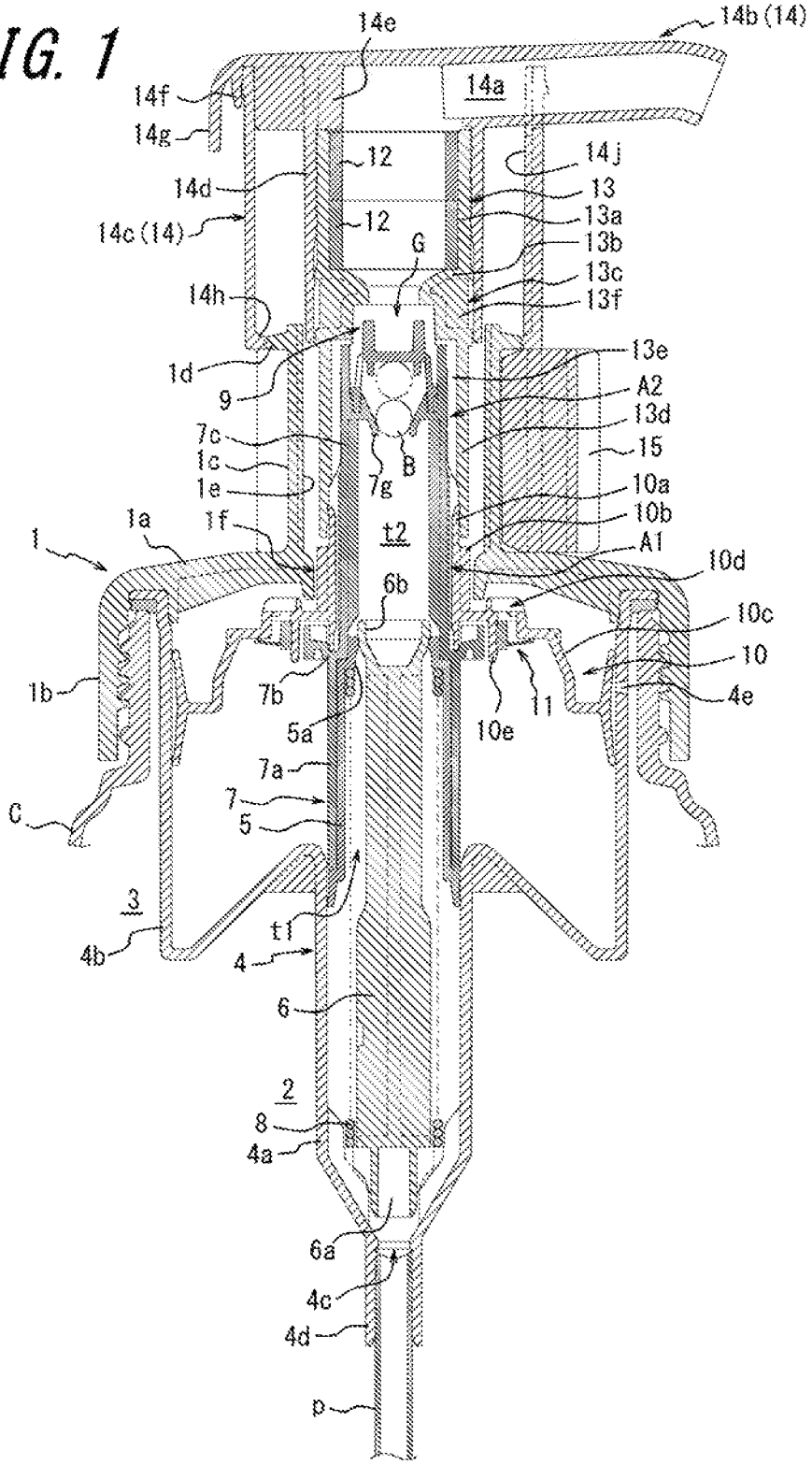
FIG. 1 is a sectional view of a foamer dispenser that is mounted on a mouth of a container, according to one of embodiments of the present disclosure.
Figure 2:
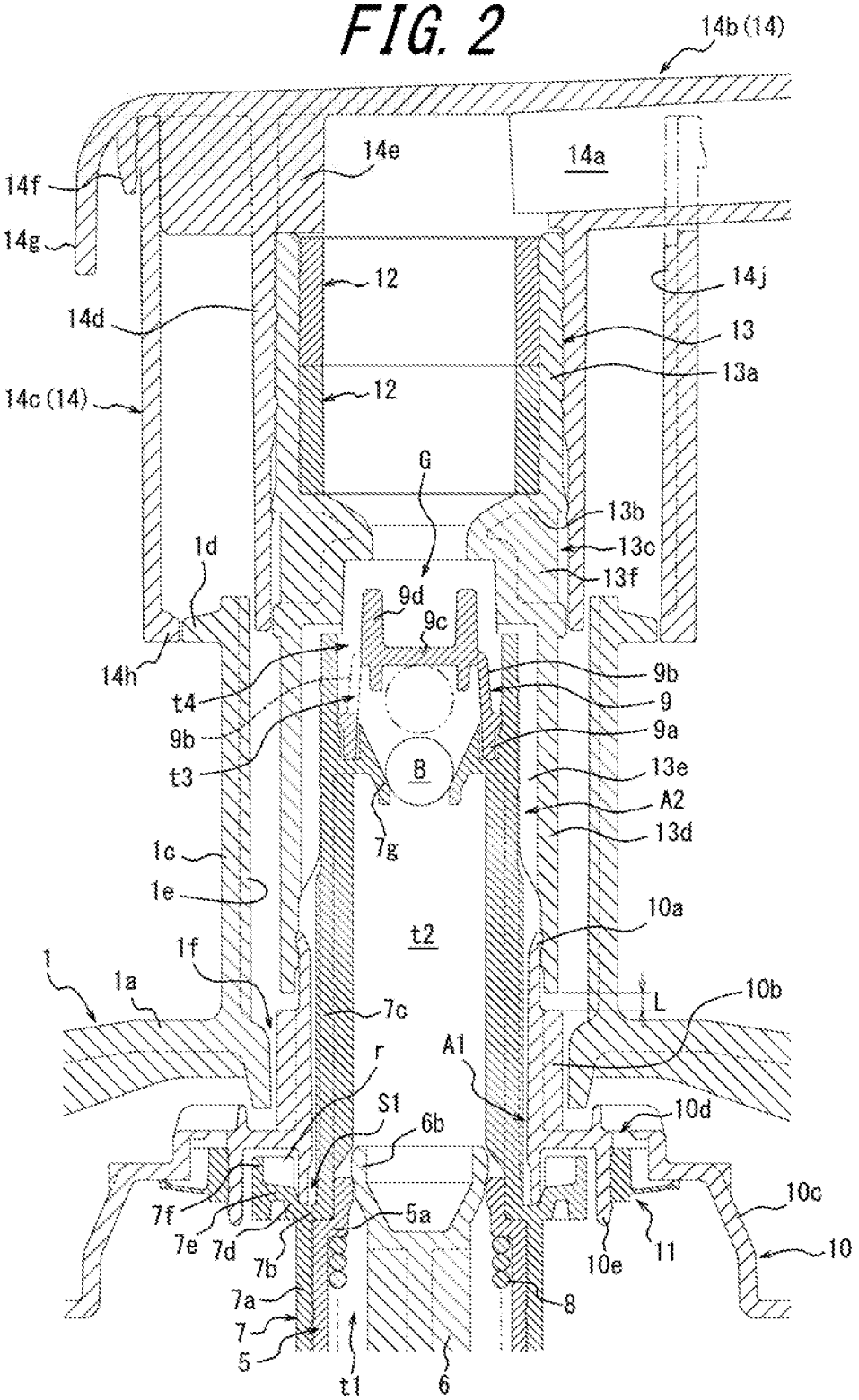
FIG. 2 is a partially enlarged sectional view of the foamer dispenser of FIG. 1 (in which a stopper is released)
Figure 3:
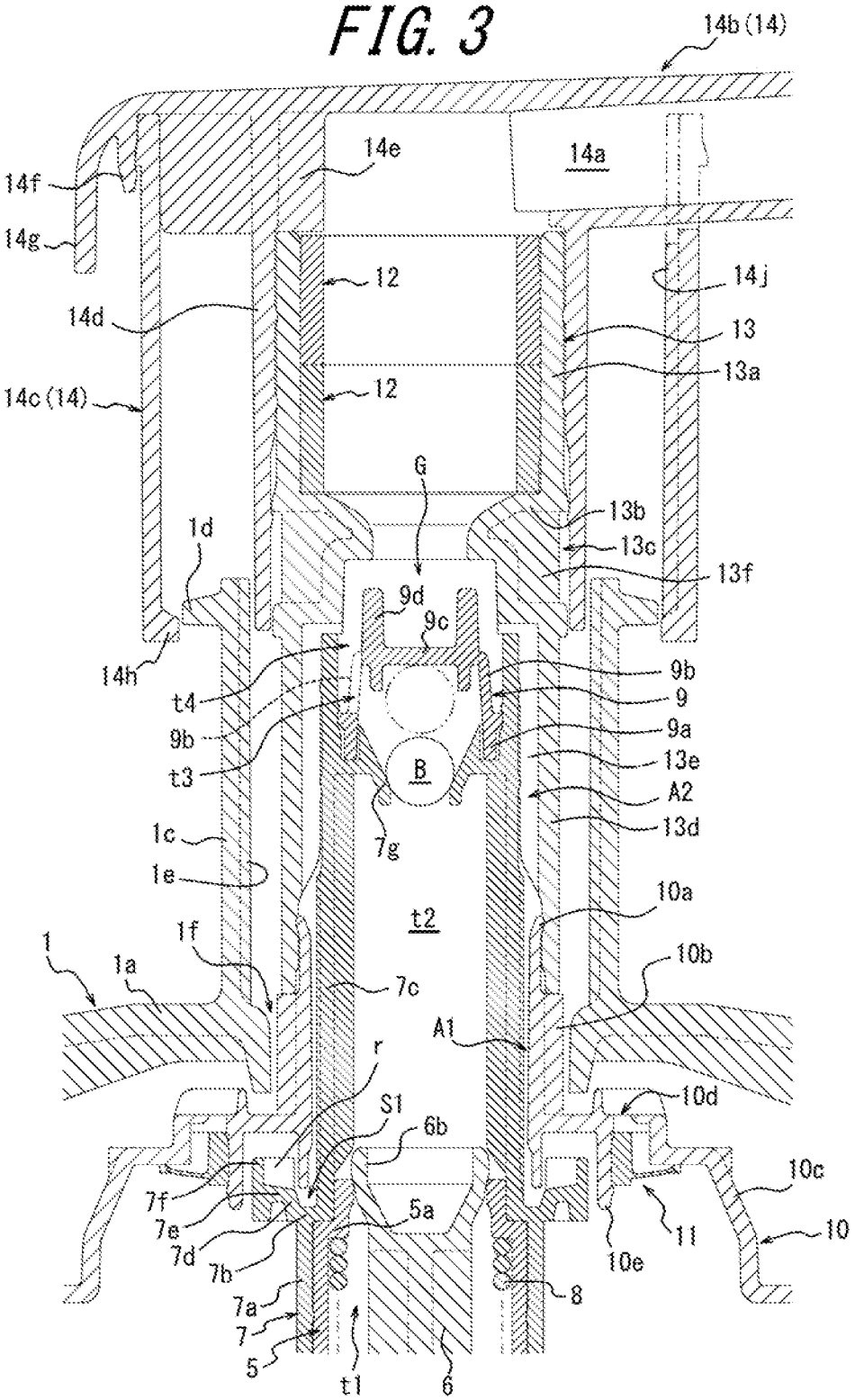
FIG. 3 is a partially enlarged sectional view of a state where a nozzle head starts to be depressed from the state of FIG. 2.

The following describes a foamer dispenser according to one of embodiments of the present disclosure in detail with reference to the drawings. FIG. 1 is a sectional view of a foamer dispenser that is mounted on a mouth of a container, according to one of embodiments of the present disclosure, FIG. 2 is a partially enlarged sectional view of the foamer dispenser of FIG. 1, and FIG. 3 is a partially enlarged sectional view of a state where a nozzle head starts to be depressed from the state of FIG. 2. FIG. 2 illustrates a state (hereinafter, called "the initial position") where a stopper of FIG. 1 is released and where a nozzle head is urged upward by a spring which is later described to be ready to be depressed. In the present description, claims, abstract, and drawings, an "upward" direction and a "downward" direction refer to directions defined when a container mounted with the foamer dispenser is in use.

Reference numeral 1 in FIG. 1 denotes a base cap that is held to a mouth of a container C. The base cap 1 includes a top surface wall 1*a* and an outer wall 1*b* suspended from an edge portion of the top surface wall 1*a*, and the outer wall 1*b* is provided on an inner side thereof with a screw portion configured to be screwed with a screw portion provided in the mouth of the container C to be held thereto detachably. The base cap 1 may be held to the container C by using any known structure, such as an undercut. The base cap 1 further includes a hollow neck portion 1*c* extending upward from the middle of the top surface wall 1*a*. The hollow neck 1 portion 1*c* is provided, in an upper part thereof, with an annular convex portion 1*d* protruding outward in the radial direction and is also provided, on an inner circumferential surface thereof, with a rib 1*e* extending vertically. The hollow neck portion 1*c* defines, inside thereof, a through hole if extending along the outer wall 1*b* to communicate with the inside of the container.

Reference numerals 2 and 3 denote two pumps suspended from and held to the mouth of the container C and respectively configured to suck, pressurize, and pump a content medium and air. The content medium pump 2 and the air pump 3 are formed by a single cylinder 4 including a small-diameter tubular body 4*a* and a large-diameter tubular body 4*b* arranged coaxially in series. A bottom portion of the large-diameter tubular body 4*b* is coupled integrally to an upper portion of the small-diameter tubular body 4*a*. The cylinder 4 is provided, in an upper portion thereof, with a flange extending outward in the radial direction. To suspend and hold the cylinder 4 from and by the container C, a gasket is disposed on a lower surface side of the flange to be sandwiched between the flange and the mouth of the container C.

Herein, the content medium pump 2 includes a suction port 4*c* provided in a bottom portion of the small-diameter tubular body 4*a* for inflow of the content medium contained in the container C. The content medium pump 2 further includes a fitting tube 4*d* provided in an edge portion of the suction port 4*c*. A suction pipe p extending toward a bottom portion of the container C is fitted to and held by the fitting tube 4*d*. In the small-diameter tubular body 4*a*, a hollow piston 5 is disposed in abutment with an inner circumferential surface of the small-diameter tubular body 4*a* in a manner such that the hollow piston 5 is slidable along an axis of the small-diameter tubular body 4*a*. The hollow piston 5 is provided inside thereof with an internal passage t1, in which a poppet 6 is disposed. An upper portion of the hollow piston 5 is reduced in diameter to form a stepped portion 5*a*. The poppet 6 includes, in a lower end thereof, a valve portion 6*a* configured to open and close the suction port 4*c*, and the poppet 6 also includes, in an upper end thereof, a valve portion 6*b* configured to open and close an outlet of the internal passage t1. Furthermore, a hollow stem 7 is disposed on an outer side of the hollow piston 5. The hollow stem 7 includes a lower tubular wall 7*a* surrounding the hollow piston 5, a flange (a middle flange) 7*b* coupled integrally to the lower tubular wall 7*a* in an upper portion of the lower tubular wall 7*a*, and an upper tubular wall 7*c* standing on the middle flange 7*b* to extend through the through hole if of the base cap 1. Moreover, a spring 8 is disposed between the poppet 6 and the hollow piston 5. Accordingly, the hollow piston 5 and the hollow stem 7 are elastically supported in a slidable manner.

As illustrated in FIG. 2, the aforementioned middle flange 7*b* protrudes from an outer circumferential surface of the upper tubular wall 7*c* outward in the radial direction, and an edge portion of the middle flange 7*b* that is located on an inner circumferential side thereof is configured to abut against the stepped portion 5*a* of the hollow piston 5. Furthermore, the middle flange 7*b* is provided with an annular wall (a middle annular wall) 7*d* standing on an upper surface of the middle flange 7*b*. The above structure creates concave space S1, which is open upward, to be defined by the outer circumferential surface of the upper tubular wall 7*c*, the middle flange 7*b*, and the middle annular wall 7*d*. The middle flange 7*b* is also provided with an inclined wall 7*e* that is coupled integrally to an upper portion of the middle annular wall 7*d* and that is inclined upward toward an outer side in the radial direction. The inclined wall 7*e* has an outer edge to which an outer annular wall 7*f* is coupled integrally. The outer annular wall 7*f* in the present embodiment has an upper portion protruding upward from an upper surface of the inclined wall 7*e*. On an upper surface of the inclined wall 7*e*, a guide rib r is provided. The guide rib r is located on an outer side of a tubular guide 10*a* at a distance therefrom in the circumferential direction. In the present embodiment, the inclined wall 7*e* and the outer annular wall 7*f* are connected via the guide rib r.

As illustrated in FIG. 2, the hollow stem 7 further includes, in an upper portion of the upper tubular wall 7*c*, an inward flange 7*g* extending inward in the radial direction. Above the inward flange 7*g*, a ball valve B configured to be held against the inward flange 7*g* as a valve seat, and a cover member 9 configured to be fitted to and held by the upper tubular wall 7*c* and to prevent the ball valve B from slipping out. The cover member 9 herein includes an annular lower wall 9*a* configured to be locked against an inner circumferential surface of the upper tubular wall 7*c*, a plurality of leg portions 9*b* coupled integrally to the lower wall 9*a* and disposed at an interval in the circumferential direction, a flat plate wall 9*c* which is coupled integrally to upper portions of the leg portions 9*b*, and an annular upper wall 9*d* standing on the flat plate wall 9*c*.

As illustrated in FIG. 1, the air pump 3 includes an air piston 10 configured to abut against an inner circumferential surface of the large-diameter tubular body 4*b* and disposed slidably along an axis thereof. The air piston 10 includes, on an inner side thereof in the radial direction, a tubular guide 10*a* surrounding the hollow stem 7 and protruding thorough the through hole if of the base cap 1 in the initial position. As illustrated in FIG. 2, a gap between an outer side of the hollow stem 7 and an inner side of the tubular guide 10*a* defines an airway (the first airway) A1 disposed above the concave space S1 for letting air pass. In the initial position, a lower end of the tubular guide 10*a* abuts against at least one of the middle flange 7*b* and the middle annular wall 7*d*. As described later, the hollow stem 7 may slightly slide relative to the air piston 10 and serves as a valve that opens and closes the first airway A1 by the lower end of the tubular guide 10*a* coming into and out of abutment with the middle flange 7*b* (and/or the middle annular wall 7*d*). Furthermore, the tubular guide 10*a* is provided, on an outer circumferential surface thereof, with a plurality of ribs 10*b*. From the tubular guide 10*a*, a partition wall 10*c* extends outward in the radial direction to define space between the tubular guide 10*a* and the large-diameter tubular body 4*b* in which air is pressurized, and the partition wall 10*c* is provided with an opening 10*d* through which air is introduced into the large-diameter tubular body 4*b*. The partition wall 10*c* is also provided, on a lower surface thereof, with an annular rib 10*e* suspended from an inner side of the opening 10*d* in the radial direction. The annular rib 10*e* is fitted with and holds a check valve 11 that opens and closes the opening 10*d*.

Above the hollow stem 7, there is provided a nozzle head 14, in which a mixture of the content medium and air is foamed by foaming members (mesh rings) 12 disposed inside the hollow stem 7 and from which the foamed mixture is dispensed to the outside through an internal passage 14*a*. The nozzle head 14 in the present embodiment includes a jet ring 13 configured to hold the mesh rings 12, and the mesh rings 12 are held in the nozzle head 14 by way of the jet ring 13.

The mesh rings 12 in the present embodiment each include a ring-shaped main body portion having one end to which a mesh is attached. The mesh ring used herein has a larger dimension (diameter) than a conventional mesh ring. In the present embodiment, a total of two mesh rings 12 are attached to the jet ring 13 in a manner such that the mesh of each mesh ring faces to an outer side (i.e., that other ends of the mesh rings to which a mesh is not attached are joined to each other).

The jet ring 13 includes an upper tubular portion 13*a* surrounding and holding the mesh ring 12, an a middle tubular portion 13*c* coupled integrally to the upper tubular portion 13*a* and having an outer circumferential wall 13*b* that is dented inward in the radial direction to support the foaming member from below, and a lower tubular portion 13*d* coupled integrally to the middle tubular portion 13*c* and having a lower end portion configured to surround an upper end portion of the tubular guide 10*a*. The above structure reduces a diameter of the middle tubular portion 13*c* and allows reduction in amount of resin to be used. Furthermore, the outer circumferential wall 13*b*, which is dented on the inner side in the radial direction, is capable of supporting the mesh ring 12 from below.

The lower tubular portion 13*d* has an inner circumferential surface that is provided with a plurality of vertical ribs 13*e* configured to abut against the outer circumferential surface of the upper tubular wall 7*c* to fit and hold the jet ring 13 thereto. The vertical ribs 13*e* each extend vertically along an axis of the lower tubular portion 13*d* and have an upper portion extending to the inner side in the radial direction along a lower surface of the middle tubular portion 13*c*. Thus, a gap (the second airway A2), which communicates with the first airway A1 and which extends vertically along the axis of the lower tubular portion 13*d* and extends to the inner side in the radial direction along the lower surface of the middle tubular portion 13*c*, is defined between any two adjacent vertical ribs 13*e*. Furthermore, the outer circumferential wall 13*b* of the middle tubular portion 13*c* is provided with at least one rib 13*f* (several ribs 13*f* in the present embodiment) that extends vertically. The above structure reinforces the middle tubular portion 13*c* having a small-diameter. Additionally, in the initial position as illustrated in FIG. 2, a gap having a length L is defined between a lower end of the lower tubular portion 13*d* and each rib 10*b* of the air piston 10.

The nozzle head 14 further includes a nozzle head main body portion 14*b*, in which an internal passage 14*a* for inflow of the content medium is defined, and a head ring 14*c* configured to be positioned on an outer side of the hollow neck portion 1*c* of the base cap 1 in the radial direction when the nozzle head 14 is depressed.

The nozzle head main body portion 14*b* is provided, on a back surface thereof, with an inner tubular wall 14*d* to which the upper tubular portion 13*a* is fitted and held, a rib 14*e* configured to prevent the mesh ring 12 mounted to the jet ring 13 from slipping out upward, and an annular fitting wall 14*f* between which and the rib 14*e* the head ring 14*c* is fitted and held. The nozzle head main body portion 14*b* also has an outer edge provided with an edge wall 14*g* surrounding an upper portion of the head ring 14*c*. Although not illustrated, the upper portion of the head ring 14*c* may be partially cut out so that air may be introduced between the head ring 14*c* and the inner tubular wall 14*d* from the outside through the cut-out.

The head ring 14*c* is provided, in a lower end portion thereof, with an annular convex portion 14*h* protruding inward in the radial direction and is also provided, on an inner surface thereof, with a rib 14*j* extending vertically and protruding to substantially the same extent as the convex portion 14*h*.

Between the top surface wall 1*a* of the base cap 1 and the head ring 14*c*, there is further provided a stopper 15 configured to prevent the nozzle head 14 to be depressed unintentionally. The stopper 15, in its plan view, has a substantially C shape, and may be mounted detachably from a lateral side of the hollow neck portion 1*c*.

In the foamer dispenser structured above, when the stopper 15 of FIG. 1 is released and the nozzle head 14 is depressed, the hollow stem 7 fitted with the jet ring 13 slightly slides relative to the air piston 10 by the length L of FIG. 2. That is to say, sliding of the air piston 10 starts later than sliding of the hollow stem 7 by the length L. Consequently, as illustrated in FIG. 3, the lower end of the tubular guide 10*a* comes out of abutment with the middle flange 7*b*, thereby letting the inside of the air piston 10 communicate with the first airway A1. At this time, although, when the nozzle head 14 is depressed obliquely, an outer circumferential surface of the hollow stem 7 is pressed against an inner circumferential surface of the tubular guide 10*a*, and this might hinders the first airway A1 from opening sufficiently because of insufficient sliding of the hollow stem 7 relative to the air piston 10, the hollow stem 7 according to the present disclosure, with the guide rib r provided in the middle flange 7*b*, is capable of sliding smoothly under the guide of the outer circumferential surface of the tubular guide 10*a*, thereby preventing such a problem effectively. When the nozzle head 14 continues to be depressed, the displaced air piston 10 pressurizes air that is present inside the air piston 10, and the pressurized air flows along the first airway A1 and the second airway A2 toward space (confluence space G) defined by the cover member 9 and the jet ring 13.

On the other hand, in the small-diameter tubular body 4*a*, the valve portion 6*a* of the poppet 6 comes into abutment against an inner surface of the small-diameter tubular body 4*a* to close the suction port 4*c*, and an inside of the small-diameter tubular body 4*a* is pressurized. When the nozzle head 14 is depressed further, the valve portion 6*b* of the poppet 6 comes off the outlet of the internal passage t1 provided in the hollow piston 5, and the content medium that is present in the internal passage t1 flows into an inside of the upper tubular wall 7*c* (an inner passage t2) of the hollow stem 7. As illustrated in FIG. 3, the flowing content medium is once segmented into several streams between adjacent leg portions 9*b* (passages t3) and then, gathers again into a cylindrical single passage (a passage t4) defined between the upper tubular wall 7*c* and the upper wall 9*d*. Subsequently, the content medium, together with the air that has passed through the second airway A2, flows to the confluence space G.

The content medium, which has been mixed with air in the confluence space G, passes through the mesh rings 12 to be foamed and flows along the internal passage 14*a* provided in the nozzle head 14 to be dispensed to the outside.

Once the nozzle head 14 is depressed completely and the depressing force is released, the hollow piston 5 and the hollow stem 7 return to the initial position due to elasticity of the spring 8.

In this returning stroke, the poppet 6 is displaced in conjunction with upward sliding of the hollow piston 5. Consequently, the suction port 4*c* provided in the small-diameter tubular body 4*a* is opened, and the outlet of the internal passage t1 provided in the hollow piston 5 is closed. Furthermore, since the ball valve B is seated against the inward flange 7*g*, the inside of the small-diameter tubular body 4*a* assumes negative pressure, and the content medium contained in the container is sucked into the small-diameter tubular body 4*a* through the suction port 4*c*.

On the other hand, in the large-diameter tubular body 4*b*, since the upward sliding of the air piston 10 starts later by the length L, the first airway A1 is closed by the lower end of the tubular guide 10*a* abutting against the middle flange 7*b* as illustrated in FIG. 2. Accordingly, when the air piston 10 starts to slide upward, the inside of the air piston 10 is placed under negative pressure. As a result, the check valve 11, which has closed the opening 10*d*, comes off the opening 10*d*, and air flows to the inside of the air piston 10 from the cut-out (which is not illustrated) formed in the upper portion of the head ring 14*c* through space between the head ring 14*c* and the inner tubular wall 14*d*, an inside of the hollow neck portion 1*c* included in the base cap 1, and the opening 10*d*. Additionally, the large-diameter tubular body 4*b* is provided, in an upper portion thereof, with a lateral hole 4*e* as illustrated in FIG. 1, and the air flowing through the inside of the hollow neck portion 1*c* included in the base cap 1 also flows into the container C through the lateral hole 4*e*. With this structure, the inside of the container C does not remain under negative pressure even upon dispensing of the content medium from the container C.

Repeating the depression of the nozzle head 14 and the return to the initial position as described above allows the content medium contained in the container to be dispensed in the form of foam successively.

In the foamer dispenser of the present embodiment, even when the content medium that is present in the confluence space G flows backward to the second airway A2 and the first airway A1, the outer annular wall 7*f* provided in the outer edge of the middle flange 7*b* effectively prevents the problem of the content medium dripping to the large-diameter tubular body 4*b*. Accordingly, a satisfactory quality of the foam is maintained. Furthermore, since in the present embodiment the concave space S1 is defined below the first airway A1, the backflow of the content medium may be pooled, and moreover, the content medium is likely to return to the concave space S1 by the inclined wall 7*e*. Accordingly, it is further ensured that a satisfactory quality of the foam is maintained.

Additionally, in the initial position as illustrated in FIG. 1, a gap between the hollow neck portion 1*c* of the base cap 1 and the head ring 14*c* of the nozzle head 14 is reduced by the convex portion 1*d* of the base cap 1 and the convex portion 14*h* of the nozzle head 14. This structure prevents water from entering into the foamer dispenser from the outside. Furthermore, the edge wall 14*g* of the nozzle head main body portion 14*b* covers the cut-out (which is not illustrated) formed in the upper portion of the head ring 14*c* to serve as an air inlet into the foamer dispenser. This structure prevents water from entering through the cut-out effectively. Moreover, the ribs 10*b* are provided in the tubular guide 10*a* of the air piston 10, the rib 1*e* is provided on the inner circumferential surface of the hollow neck portion 1*c* of the base cap 1, and the rib 14*j* is provided on the inner surface of the head ring 14*c* of the nozzle head 14. Accordingly, although portions of the nozzle head 14 that oppose to the ribs might be pressed against the ribs when the nozzle head 14 is depressed obliquely, the contact area is reduced due to the ribs, and satisfactory operability is maintained without having to apply a very strong depressing force.

EXAMPLE

The foamer dispenser of the present embodiment was mounted to a container filled with a content medium (a skin cleanser) indicated in Table 1, and a dispensing condition of the content medium was studied. It has been confirmed that the content medium may be dispensed in the form of foam of a satisfactory quality from beginning to end of use. Furthermore, operability (in terms of pressing force and depression in various directions) of the nozzle head has been found satisfactory.

TABLE 1

| Ingredients | Mass % |
|---|---|
| Sodium laurylaminopropionate | 3 |
| Lauramidopropyl betaine | 20 |
| Sodium N-cocoyl methyl taurate | 2 |
| Polyoxyethylene (2) alkyl (12-14) sulfosuccinate disodium | 10 |
| Sorbitol | 3 |
| Glycerin | 3 |
| Proplylene glycol | 20 |
| Sodium benzoate | 0.9 |
| Citrate | 0.7 |

TABLE 1-continued

| Ingredients | Mass % |
|---|---|
| Honey | 0.1 |
| Sodium DL-pyrrolidone carboxylate solution | 0.1 |
| Dye | 0.01 |
| Purified water | Reminder |

INDUSTRIAL APPLICABILITY

The foamer dispenser of the present disclosure prevents backflow of the content medium into the air cylinder and accordingly, maintains a satisfactory quality of the foam. Furthermore, even when upsizing of the foaming member is required to increase the dose of the content medium per actuation, the amount of resin to be used in the jet ring is minimized, and the shape of the jet ring is simplified.

REFERENCE SIGNS LIST

1 base cap
1*a* top surface wall
1*b* outer wall
1*c* hollow neck portion
1*d* convex portion
1*e* rib
1*f* through hole
2 content medium pump (pump)
3 air pump (pump)
4 cylinder
4*a* small-diameter tubular body
4*b* large-diameter tubular body
4*c* suction port
4*d* fitting tube
4*e* lateral hole
5 hollow piston
5*a* stepped portion
6 poppet
6*a* valve portion
6*b* valve portion
7 hollow stem
7*a* lower tubular wall
7*b* middle flange (flange)
7*c* upper tubular wall
7*d* middle annular wall (annular wall)
7*e* inclined wall
7*f* outer annular wall
7*g* inward flange
8 spring
9 cover member
9*a* lower wall
9*b* leg portion
9*c* flat plate wall
9*d* upper wall
10 air piston
10*a* tubular guide
10*b* rib
10*c* partition wall
10*d* opening
10*e* annular rib
11 check valve
12 mesh ring (foaming member)
13 jet ring
13*a* upper tubular portion
13*b* outer circumferential wall
13*c* middle tubular portion

13*d* lower tubular portion
13*e* vertical rib
13*f* rib
14 nozzle head
14*a* internal passage
14*b* nozzle head main body portion
14*c* head ring
14*a* inner tubular wall
14*e* rib
14*f* fitting wall
14*g* edge wall
14*h* convex portion
14*j* rib
15 stopper
A1 first airway (airway)
A2 second airway (airway)
B ball valve
C container
G confluence space
p suction pipe
r guide rib
S1 concave space
t1 internal passage
t2 inner passage
t3 passage
t4 passage

The invention claimed is:

1. A foamer dispenser, comprising:

a base cap held by a mouth of a container; two pumps suspended from and held to the mouth of the container by the base cap, the two pumps comprising one pump configured to suck, pressurize, and pump a content medium and the other pump configured to suck, pressurize, and pump air; and a nozzle head configured to mix the content medium and the air pumped from the two pumps and to foam a mixture of the content medium and the air by a foaming member disposed inside the nozzle head to be dispensed to outside through an internal passage, wherein the pump configured to suck, pressurize, and pump the content medium includes: a small-diameter tubular body provided in a bottom portion thereof with a suction port for inflow of the content medium; a hollow piston disposed in abutment with an inner circumferential surface of the small-diameter tubular body and configured to slide toward the bottom portion of the small-diameter tubular body to pressurize and pump the content medium that is present in the small-diameter tubular body; and a hollow stem including an inner passage through which the content medium pumped from the hollow piston is supplied to the nozzle head and also including a flange protruding from an outer circumferential surface of the hollow stem outward in a radial direction, the pump configured to suck, pressurize, and pump the air includes: a large-diameter tubular body including a bottom portion coupled integrally to the small-diameter tubular body; an air piston disposed in abutment with an inner circumferential surface of the large-diameter tubular body and configured to slide toward the bottom portion of the large-diameter tubular body to pressurize and pump the air that is present in the large-diameter tubular body; and a tubular guide that is coupled integrally to the air piston, that surrounds the hollow stem to define a first airway between the hollow stem and the tubular guide, that holds the hollow stem in a manner such that the hollow stem is slidable, and that is configured to come out of abutment with the flange in response to downward sliding of the hollow stem, thereby opening the first airway to supply the air pumped by the air piston to the nozzle head through the first airway, and the flange is provided with: an outer annular wall protruding upward from an outer edge of the flange; and a guide rib located on an outer side of the tubular guide in the radial direction and configured to be guided by the tubular guide during sliding of the hollow stem.

2. The foamer dispenser of claim 1, wherein the outer annular wall and the flange are coupled integrally via the guide rib.

3. The foamer dispenser of claim 2, wherein the nozzle head includes a jet ring that holds the foaming member, and the jet ring includes: an upper tubular portion surrounding and holding the foaming member; a middle tubular portion coupled integrally to the upper tubular portion and having an outer circumferential wall that is dented inward in the radial direction to support the foaming member from below; and a lower tubular portion that is coupled integrally to the middle tubular portion, that has an inner circumferential surface provided with a plurality of vertical ribs abutting against the outer circumferential surface of the hollow stem to be fitted and held to the hollow stem, and that defines a second airway communicating with the first airway between any two adjacent vertical ribs.

4. The foamer dispenser of claim 3, wherein the jet ring further includes at least one rib that is provided on the outer circumferential wall dented inward in the radial direction and that extends vertically.

5. The foamer dispenser of claim 1, wherein the nozzle head includes a jet ring that holds the foaming member, and the jet ring includes: an upper tubular portion surrounding and holding the foaming member; a middle tubular portion coupled integrally to the upper tubular portion and having an outer circumferential wall that is dented inward in the radial direction to support the foaming member from below; and a lower tubular portion that is coupled integrally to the middle tubular portion, that has an inner circumferential surface provided with a plurality of vertical ribs abutting against the outer circumferential surface of the hollow stem to be fitted and held to the hollow stem, and that defines a second airway communicating with the first airway between any two adjacent vertical ribs.

6. The foamer dispenser of claim 5, wherein the jet ring further includes at least one rib that is provided on the outer circumferential wall dented inward in the radial direction and that extends vertically.

* * * * *